US008807874B2

(12) United States Patent
Zeng et al.

(10) Patent No.: US 8,807,874 B2
(45) Date of Patent: Aug. 19, 2014

(54) DRY-TREE SEMI-SUBMERSIBLE PRODUCTION AND DRILLING UNIT

(75) Inventors: Yijian Zeng, Katy, TX (US); Leiv Gunnar Wanvik, Houston, TX (US); Tao Wang, Katy, TX (US); Stein Rasmussen, Katy, TX (US); Renjian Lu, Houston, TX (US)

(73) Assignee: Aker Solutions Inc., Houston, TX (US)

( * ) Notice: Subject to any disclaimer, the term of this patent is extended or adjusted under 35 U.S.C. 154(b) by 0 days.

(21) Appl. No.: 13/641,909

(22) PCT Filed: Apr. 25, 2011

(86) PCT No.: PCT/US2011/033755

§ 371 (c)(1),
(2), (4) Date: Oct. 18, 2012

(87) PCT Pub. No.: WO2011/137061

PCT Pub. Date: Nov. 3, 2011

(65) Prior Publication Data

US 2013/0032076 A1 Feb. 7, 2013

Related U.S. Application Data

(60) Provisional application No. 61/327,947, filed on Apr. 26, 2010.

(51) Int. Cl.
*B63B 35/44* (2006.01)

(52) U.S. Cl.
USPC ..... 405/224.4; 405/223.1; 114/264

(58) Field of Classification Search
USPC ..... 405/223.1, 224, 224.2, 224.3, 224.4; 114/256, 264, 230.1, 230.13, 230.26, 114/230.27
See application file for complete search history.

(56) References Cited

U.S. PATENT DOCUMENTS

| | | | | |
|---|---|---|---|---|
| 6,467,545 | B1 * | 10/2002 | Venkataraman et al. | 166/367 |
| 7,140,317 | B2 * | 11/2006 | Wybro et al. | 114/264 |
| 7,416,025 | B2 * | 8/2008 | Bhat et al. | 405/224.4 |
| 2004/0052586 | A1 | 3/2004 | Horton, III | |
| 2005/0120935 | A1 | 6/2005 | Wybro et al. | |
| 2006/0021756 | A1 * | 2/2006 | Bhat et al. | 166/352 |
| 2006/0260526 | A1 * | 11/2006 | Kristensen et al. | 114/264 |
| 2007/0166109 | A1 * | 7/2007 | Ding et al. | 405/224 |
| 2007/0224000 | A1 * | 9/2007 | Mills et al. | 405/203 |
| 2009/0114139 | A1 * | 5/2009 | Zou | 114/266 |
| 2009/0205554 | A1 | 8/2009 | Srinivasan | |
| 2009/0235856 | A1 * | 9/2009 | Mansour et al. | 114/265 |
| 2010/0092246 | A1 * | 4/2010 | Tahar et al. | 405/201 |

(Continued)

FOREIGN PATENT DOCUMENTS

| | | | | |
|---|---|---|---|---|
| WO | 01/16458 | A1 | 3/2001 | |
| WO | WO 2012/071407 | * | 5/2012 | E21B 7/128 |

*Primary Examiner* — Frederick L Lagman

(74) *Attorney, Agent, or Firm* — Rothwell, Figg, Ernst & Manbeck, P.C.

(57) ABSTRACT

A deep draft semi-submersible production and drilling platform unit with dry trees is described. The platform unit preferably comprises four columns, a ring pontoon, a two-axis symmetrical hull with draft in the range of 100 to 155 feet, top-tensioned risers with push or pull tensioners of preferred combined vertical stiffness of 10% to 30% of the platform water plane stiffness, a wellbay with a well spacing in the range of 12 to 18 feet, a riser guiding system supported by the pontoons or at an elevated level, topside facilities supported by a box type of deck structure, mooring lines, and catenary risers.

20 Claims, 9 Drawing Sheets

(56) References Cited

U.S. PATENT DOCUMENTS

2010/0108322 A1* 5/2010 Eilertsen ..... 166/352
2011/0100639 A1* 5/2011 Roodenburg et al. ..... 405/223.1
2012/0216737 A1* 8/2012 Luo et al. ..... 114/264

* cited by examiner

100

300

600

700

900

DRY-TREE SEMI-SUBMERSIBLE PRODUCTION AND DRILLING UNIT

CROSS REFERENCE TO RELATED APPLICATION(S)

This application is a 35 U.S.C. §371 National Phase Entry Application from PCT/US2011/033755 filed Apr. 25, 2011, designating the U.S. and claiming priority to U.S. Application 61/327,947 filed Apr. 26, 2010, the disclosures of which are incorporated by reference herein in their entirety.

TECHNICAL FIELD

The present invention relates to offshore oil and gas drilling and production platforms, and more particularly, to a semi-submersible production and drilling platform unit with dry-tree or direct vertical access applications.

BACKGROUND

Referring to FIG. 1, a number of conventional deep draft semi-submersible floating production platforms supporting steel catenary risers (SCRs), and using spread mooring for station keeping have previously been successfully designed and installed. The conventional semi-submersible has proven to meet the motion suppression requirements for SCRs efficiently, and has encouraged the possibility of developing technology for facilitating top-tensioned risers (TTRs) for field development.

Top-tensioned risers with dry trees have conventionally been supported by either a tension leg platform (TLP) or a "Spar" platform. Riser stroke induced by vertical motion of the host platform is compensated through tensioners by means of hydro-pneumatic hydraulic systems designed to control riser tension within allowable values.

TTRs and dry trees are field-proven technology for both TLP and Spar, but have not previously been utilized on a semi-submersible production unit. There is an increasing trend for drilling with high-pressure (HP) risers and surface blow-out preventers (BOPs) from semi-submersible platform units. This trend represents a similar but more challenging function than a conventional dry tree system with TTRs.

In addition to the conventional semi-submersible platform, a few configurations have previously been described. For example, U.S. Patent Application Publication No. US 2003/0095839 A1 describes a floating platform for offshore drilling and production with octagonal pontoon, with specific attention to a preferred hull draft and the ratio of draft to column center-to-center distance. In U.S. Pat. No. 7,467,912 B2, an extendable draft platform (EDP) is characterized in that each of the columns comprises an upper portion having a first diameter, and a lower portion having a second diameter in order to move vertically in the column well. As another example, U.S. Patent Application Publication No. US 2009/0114139 A1 describes a dual-column semi-submersible platform having vertical columns arranged in pairs, with one of the pair disposed a distance outward from the other.

However, the need remains for a semi-submersible production and drilling platform unit using TTRs with dry trees or direct vertical access to wells, and addressing the total value and efficiency of the integrated system during entire life cycle of the product, including design, construction, integration and installation, operation, and decommission, as well as component reliability and safety.

SUMMARY

In one particular aspect, the invention provides a dry-tree semi-submersible production and drilling platform unit. The platform unit comprises a semi-submersible hull portion, a mooring portion, a topside portion, a wellbay portion, a top-tensioned riser portion, a catenary riser portion, and a riser tensioning subsystem. The semi-submersible hull portion includes a ring pontoon and at least four columns supporting the ring pontoon. The mooring portion is anchored to a sea floor and mechanically coupled to each of the at least four columns. The topside portion is supported by the hull and includes a deck box having at least one of a plated bottom and a grated bottom. The wellbay portion is positioned in a central location of the deck box and configured to support a drilling substructure, a production substructure and the top-tensioned riser portion. The wellbay portion includes a plurality of well slots arranged in a grid pattern. The drilling substructure is configured to provide vertical access to each well slot in the grid pattern. The top-tensioned riser portion includes a plurality of top-tensioned risers and at least one of dry-trees and direct vertical access to each of the plurality of wells. The catenary riser portion includes a plurality of steel catenary or flexible risers. Each of the steel catenary or flexible risers is hung from the ring pontoon. The riser tensioning subsystem has a plurality of riser tensioners. The riser tensioning subsystem is configured to provide vertical motion compensation for each of the plurality of top-tensioned risers. The riser tensioning subsystem is characterized by a tension level parameter, a stroke length parameter, and a stiffness parameter. A set of values for the tension level parameter, the stroke length parameter, and the stiffness parameter is determined based on a field water depth, a number of wells in the wellbay portion, and a predetermined topside capacity. In some embodiments, the platform unit may further comprise a riser guide frame configured to constrain a rotation-induced moment on at least one of the plurality of riser tensioners.

In some embodiments, the tension level parameter, the stroke length parameter, the stiffness parameter, and a number of top-tensioned risers may be determined such that an effective total stiffness of the riser tensioning subsystem is maintained within a range of between 10% and 30% of a platform water plane stiffness at in-place operating conditions.

In some embodiments, the hull portion may have a draft configured between about 100 feet and 155 feet. The hull portion may be further configured to suppress platform heave motions to enhance riser performance while maintaining a predetermined hull portion maximum height for quayside integration of the topside portion with the hull portion.

In some embodiments, the platform unit may be configured such that a pontoon to platform total displacement ratio is maintained in a range of between 0.3 and 0.5. The platform unit may be further configured such that a heave natural period of the platform unit is maintained within a range of between 5 seconds and 8 seconds longer than a peak period of a predetermined governing design storm with all risers installed.

In some embodiments, the plurality of well slots may be arranged in a grid pattern having a well spacing in a range of between 12 feet and 18 feet, wherein the grid pattern is one of a rectangular grid pattern and a square grid pattern. The hull portion may include six columns and a truss deck. The mooring portion may be mechanically coupled to the four corner columns of the six columns. The truss deck may be integrated with the topside portion. Alternatively, the topside portion may include an integrated truss deck.

In some embodiments, a configuration of the mooring portion may be based on a nominal stroke position of each of the plurality of riser tensioners. The respective nominal stroke positions may be determined in accordance with a predetermined maximum up stroke and a predetermined maximum down stroke relating to each of a normal operational mode, an extreme storm mode, and a survival mode. The drilling substructure may be configured to use an X-Y skidding system to provide the vertical access to each well slot in the grid pattern.

The above and other aspects and embodiments are described below with reference to the accompanying drawings.

BRIEF DESCRIPTION OF THE DRAWINGS

The accompanying drawings, which are incorporated herein and form part of the specification, illustrate various embodiments of the present disclosure and, together with the description, further serve to explain the principles of the disclosure and to enable a person skilled in the pertinent art to make and use the embodiments disclosed herein. In the drawings, like reference numbers indicate identical or functionally similar elements.

DETAILED DESCRIPTION

Figure 1:
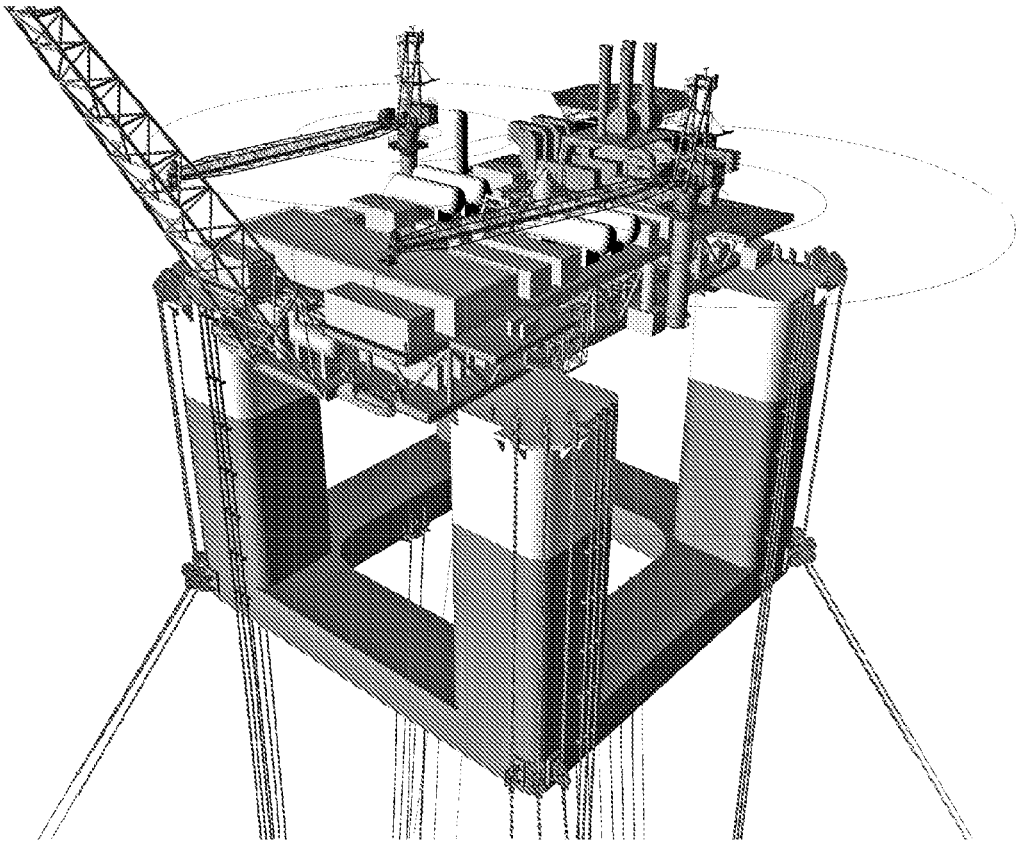
Fig. 1 (Prior Art)
FIG. 1 illustrates a conventional semi-submersible production platform.
Figure 2:
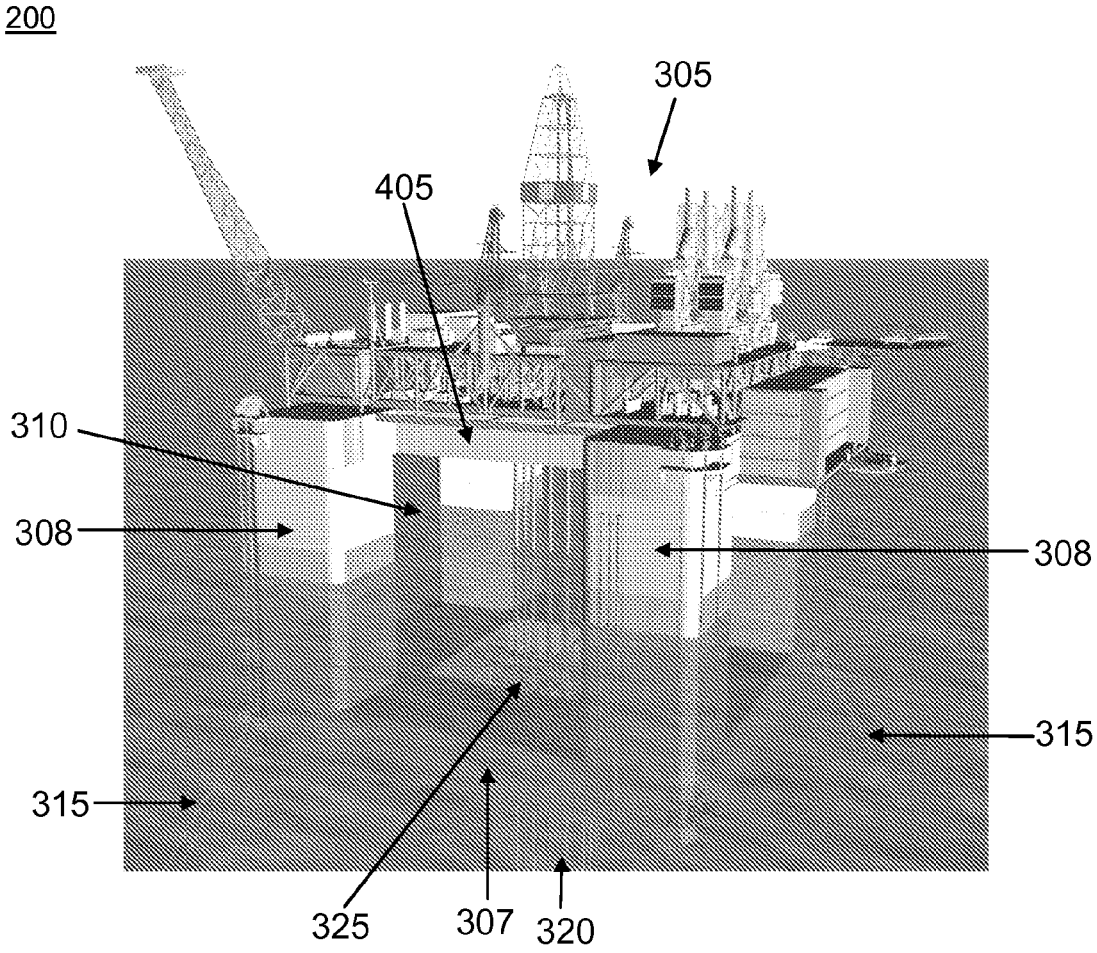
FIG. 2 illustrates a dry-tree semi-submersible production and drilling platform unit according to an exemplary embodiment of the present invention.
Figure 3:
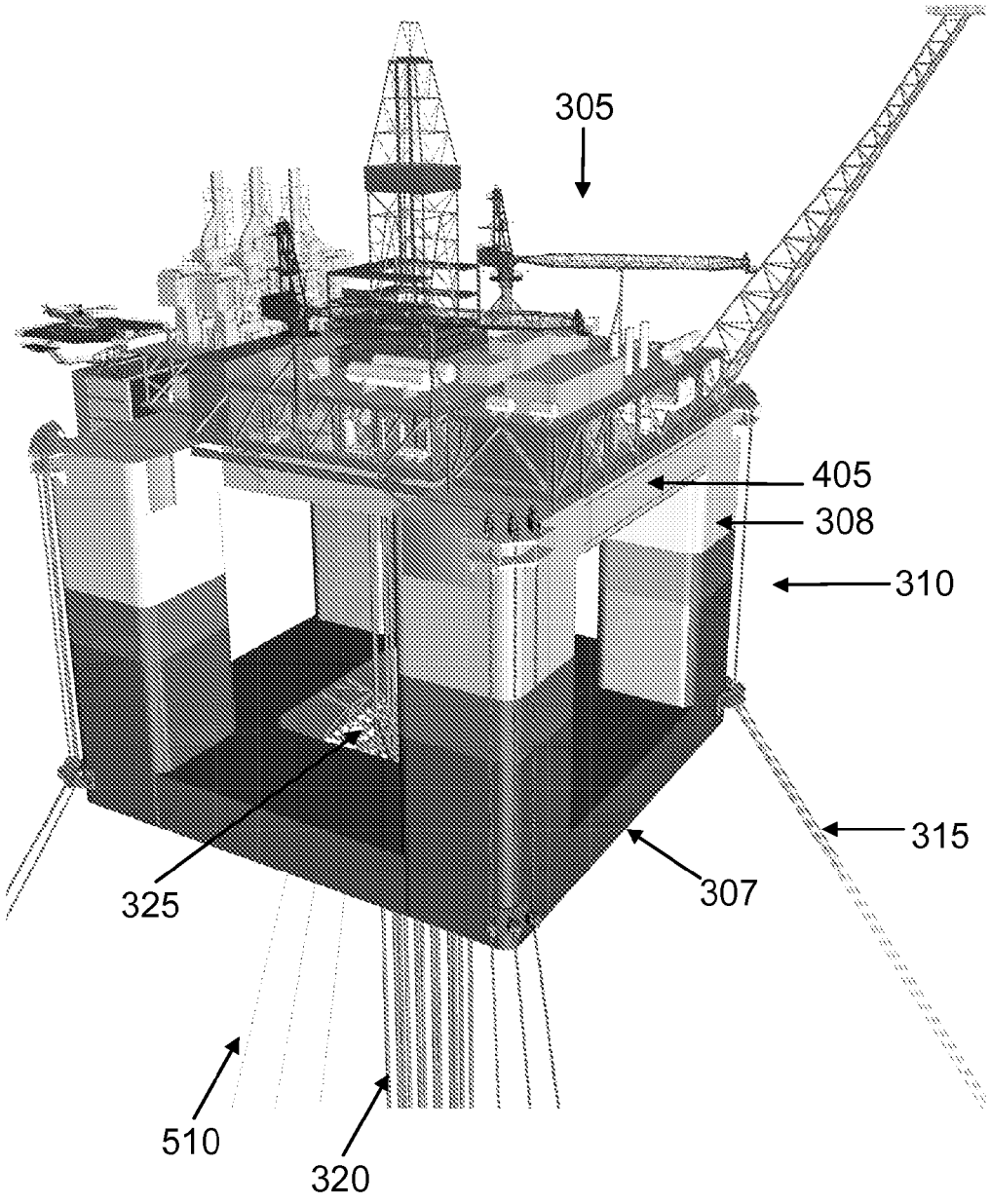
FIG. 3 illustrates a perspective view of the platform unit of FIG. 2.

In a preferred embodiment, a dry-tree semi-submersible production and drilling unit comprises a semi-submersible hull and mooring design, including a four-column and ring pontoon configuration suitable for carrying a topside portion. The topside portion preferably includes process, utilities, a drilling function, and a wellbay section for hang-off top-tensioned risers with dry-trees or direct vertical access to wells, which is designed for a target performance through analyzing a set of preferred hull, mooring and riser design parameters and arrangements of the individual platform components. By combining these preferred configuration parameters with a systematic analysis method, a project-specific and cost-effective dry-tree semi-submersible configuration is achieved.

Preferably, a target dry tree semi-submersible hull has a project-specific draft range and a set of dedicated parameters for vessel geometry, properties of risers, riser tensioners, and moorings. Preferred configuration parameters may be determined by utilizing a systematic procedure to evaluate a large population of cases. By taking both technical and economic considerations into account, this procedure yields a project-specific solution with minimum combined capital and operating cost, where technical risk is minimized through application of recognized and well-proven technologies.

Exemplary embodiments of the present invention provide a unique method for deriving an effective deep water dry-tree semi-submersible production and drilling unit that represents an advanced technology over conventional dry-tree floating systems, for example, TLP and Spar, especially for ultra-deep water fields where large topside capacities and larger well counts are preferred.

In an exemplary embodiment, the present invention provides a deep draft semi-submersible production and drilling platform unit to support TTRs with dry trees or direct vertical access (DVA). Referring to FIGS. 2-5, the platform unit preferably includes the following components:

- a two-axis symmetrical hull 310 comprising a ring pontoon 307 and four corner columns 308;
- a spread mooring system 315 connected to the platform through fairleads and chain jacks on the hull columns and anchored at the seafloor with suction or driven piles;
- topside facilities 305 supported by the hull 310 featuring a deck box structure 405 housing the process and utility facilities, drilling facilities, and living quarters;
- a wellbay area 410 housing the dry production trees and the top-tensioned risers 320 extending from wellheads at the sea floor to the wellbay, where they are maintained with respect to both operational function and structural integrity under controlled stress and displacement by means of individual tensioning devices that compensate for the platform motions;
- catenary risers 510 for export and satellite wells tieback, which are hung from the hull pontoons; and
- a riser guiding system 325 supported by pontoons at an elevated level below the deck.

In an alternative embodiment, a six-column semi-submersible hull geometry may be used, particularly in the case of a more rectangularly shaped topside deck. This configuration may be especially preferred for an integrated topside with truss decks.

Figure 6:
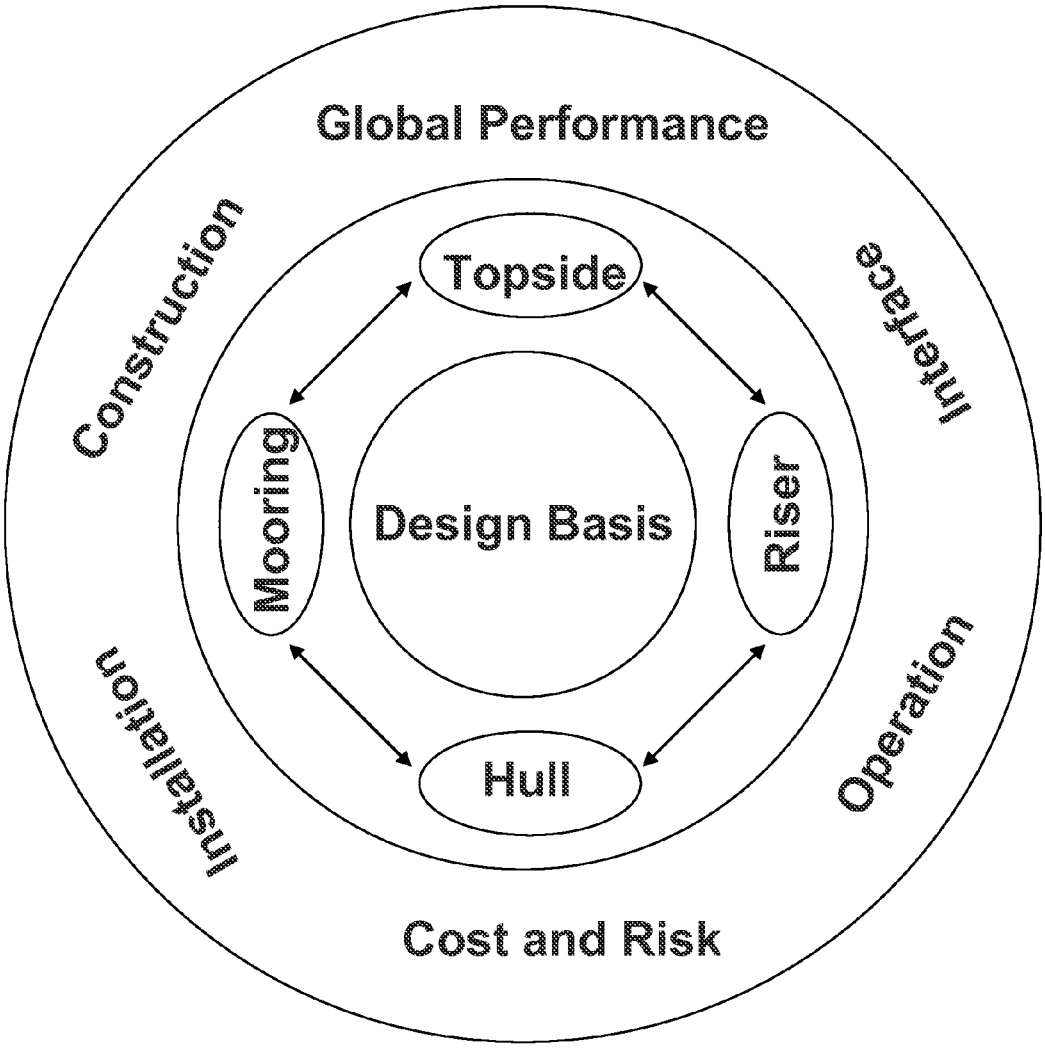
FIG. 6 illustrates a design methodology diagram for determining a design of the platform unit of FIG. 2.

Referring to FIG. 6, in a preferred embodiment of the present invention, the design specifications for a platform unit are determined by optimizing technical and economic considerations relating to installation, construction, risk, operations, interface, and global performance.

Hull configuration, especially hull draft, is an important parameter for consideration. Environmental conditions drive hydrodynamic loading on the platform, and may require a minimum hull draft to control the platform motion and riser tensioner stroke range. For quayside integration of the topside 305 and hull 310, integration yard site conditions, such as water depth, crane lift capacity, and height, may limit the maximum platform height, and thus the maximum draft and topside deck elevation. Riser tensioning system stiffness and pontoon/column displacement ratio change the platform natural period and global performance. An optimum draft and hull size may be selected from the range between the minimum and the maximum based on the overall system performance, cost and risk, as well as project execution. For example, in an exemplary embodiment, the hull draft may be configured within the range of 100 feet to 155 feet.

Riser and mooring system configuration may need not only to satisfy their functional requirements and specifications, but also may need to provide performance robustness and operation reliability. A spread mooring system 315 for station keeping may be designed to determine riser tensioner nominal stroke position as a function of allowable excursion within, e.g., 7% of water depth for a governing design storm condition.

Tensioning means for compensation of platform vertical motions may be configured such that the combined tensioning system vertical stiffness remains, e.g., in a range of 10% to 30% of the platform water plane stiffness at in-place conditions.

A pontoon-to-platform total displacement ratio may be configured, e.g., between 0.3-0.5, thereby allowing hydrodynamic cancellation effects in the heave regime to diminish dynamic response amplification effects at preferred frequencies. In many cases, the heave natural period is in the range of, e.g., 5-8 seconds longer than the peak period of a governing design storm, such as, for example, a 100-year hurricane, with all risers installed.

Figure 4:
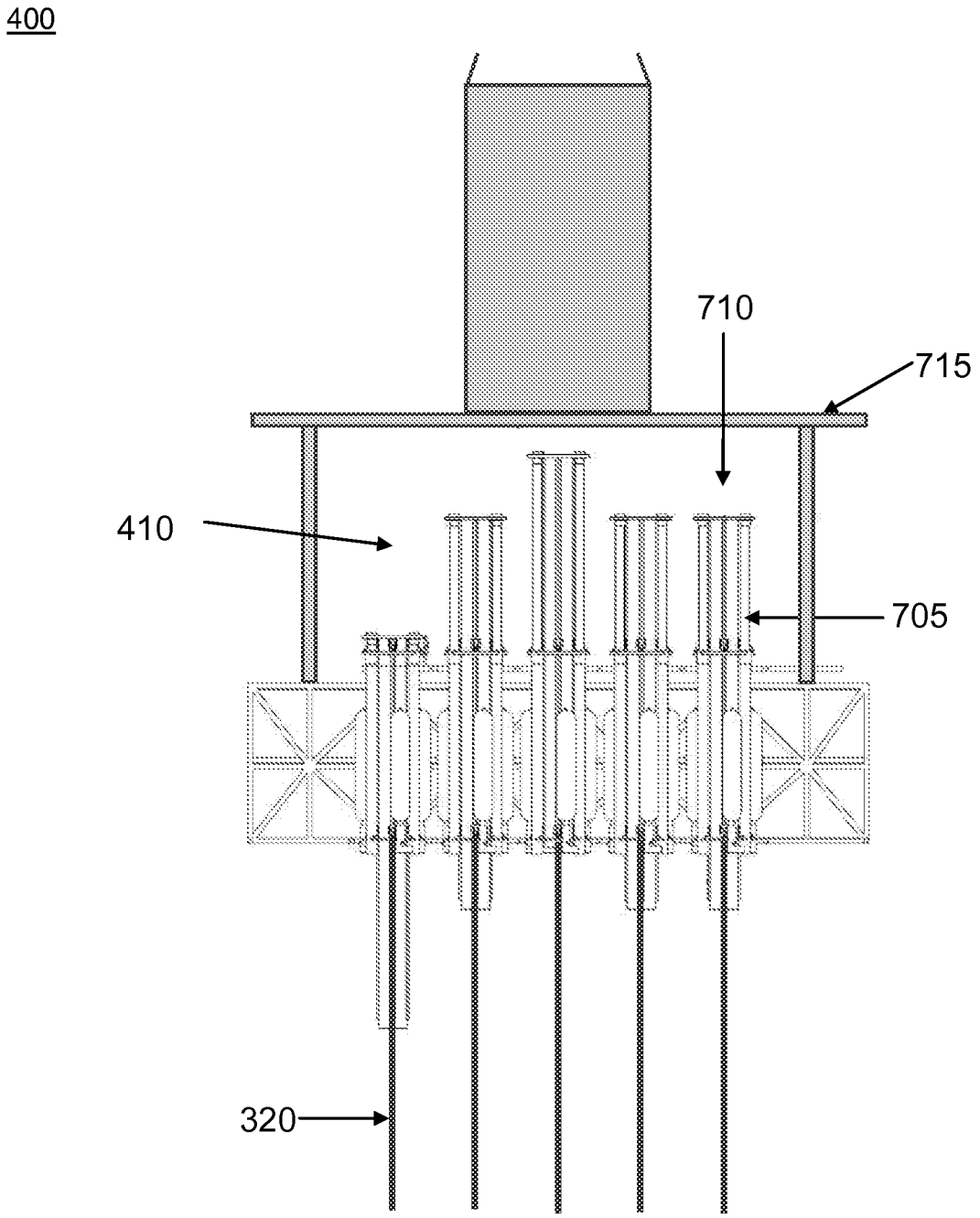
FIG. 4 illustrates a wellbay and tensioner arrangement for use in conjunction with the platform unit of FIG. 2.

Referring to FIG. 4, the platform unit also includes a wellbay portion 410 which hosts a plurality of risers through a well slot pattern 710. The well slots are preferably arranged in a grid pattern, with a well spacing in the range of, e.g., 12-18 feet. The well slot may all be positioned within a centrally located rectangle or square portion of the wellbay 410. The wellbay 410 may be configured such that Christmas trees and blow-out preventers (BOPs) and other critical pressure-containing equipment stay above the wave crest at all times.

A drilling rig substructure 715 may be carried on top of the wellbay structure 410 through an X-Y skidding system, in order to provide vertical access to all well slots in the wellbay for drilling or work-over purposes. The drilling substructure 715 may be positioned at an elevation that allows a telescopic slip joint to stroke approximate plus-or-minus eight feet before having to disconnect and pull the telescopic joint up through the rotary opening.

Hydro-pneumatic push or pull riser tensioners 705 may be used for compensation of platform vertical motions. These types of riser tensioners 705 are well known and proven technology both from operations onboard drilling rigs, TLPs and Spars. A semi-submersible platform unit may require an increased tensioner stroke range as compared with TLPs and Spars. However, the required tensioner stroke range is still significantly lower than what is required on a deep water exploration rig that features a system with, e.g., 50 feet or longer stroke compensation at a tension level of, e.g., 2,000 short tons.

The riser spring stiffness has an effect on global performance of the system. Furthermore, the riser tensioning system 705 may include the following main parameters: tension level (i.e., number of cylinders required); stroke length (i.e., more weight and need for anti-buckling design); stiffness (i.e., slope of the force versus displacement curve); and material selection. In a preferred embodiment, the effective stiffness of the combined number of riser tensioners may be maintained within, for example, a range of 10% to 30% of the platform water plane stiffness.

A lightship weight may enable the complete unit, with topside 305, after quayside integration, to be transported to a field location. Such transportation may have a maximum draft which is determined by the water depth of the transportation route. For example, for a platform unit that is integrated in a Gulf of Mexico yard, the maximum draft may be in the range of 40-42 feet.

Figure 5:
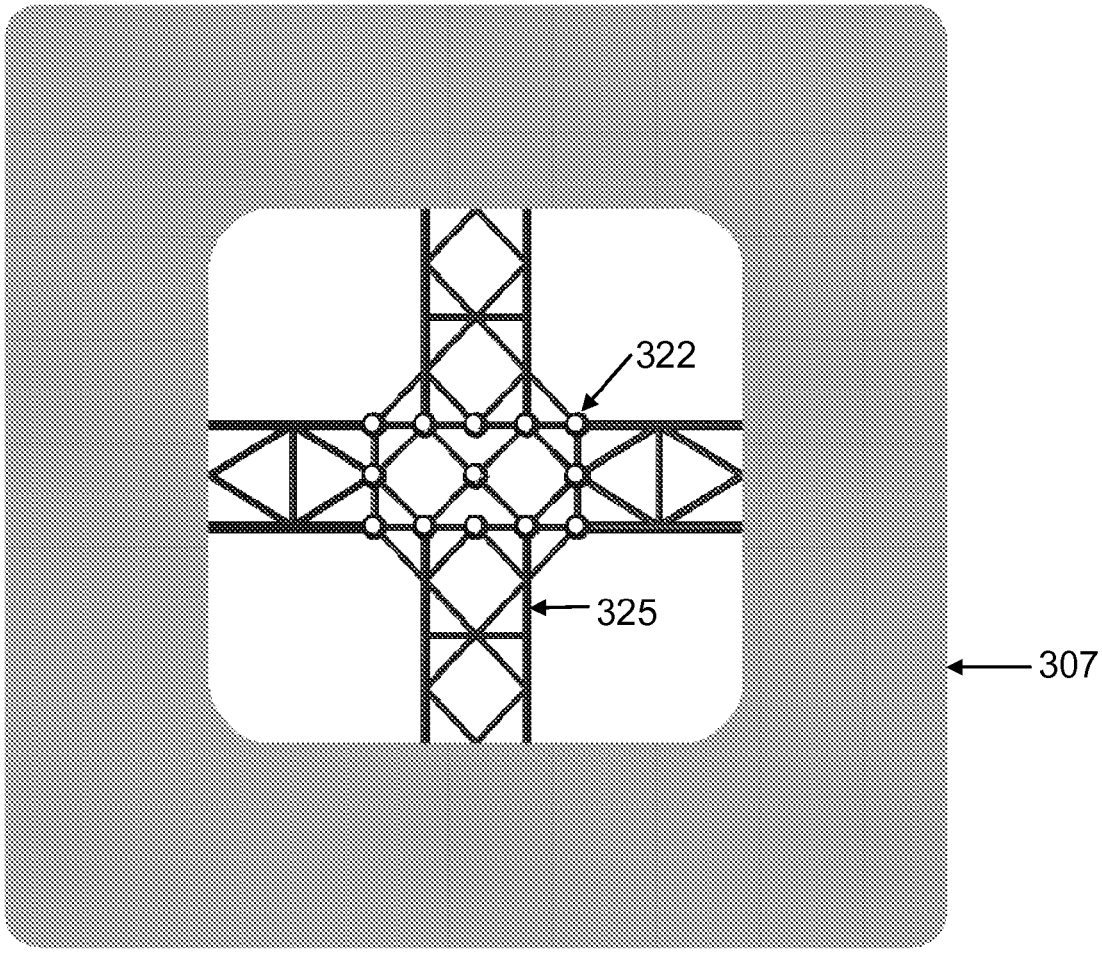
FIG. 5 illustrates a riser guide frame subsystem for use in conjunction with the platform unit of FIG. 2.

Referring to FIG. 5, a riser guide frame 325 may be used to constrain rotation-induced moment on tensioners. The riser guide frame 325 can be supported by the pontoon at the lower end of the hull 310, or supported by the topside 305 at an elevated level. Riser lateral movement is restrained in relation to hull 310 at positions of riser guides 322. If riser tensioners 705 are able to resist riser rotation-induced moment, the guide frame 325 may be eliminated. The riser guide frame structure 325 may provide horizontal or lateral constraints to the risers 320 before the risers 320 enter the wellbay 410.

A box-type deck structure 405 may span between the columns 308 with, for example, a single-plated or double-plated bottom that provides both protection of the interior areas against wave slamming and support for topside modules on top of the deck box 405. The deck box 405 may have a water-tight design that can provide emergency buoyancy in case of water ingress in the hull's columns or pontoons.

A semi-submersible hull 310 may be utilized based on the desired deck payload and acceptable station keeping, stability and motion criteria. Heave motion is governed by hull draft. Therefore, an increase in the hull draft causes a commensurate reduction in heave motion and required tensioner stroke range. This incurs additional hull and mooring costs, and reduces integration space for the topside portion 305. However, the combined tensioner system stiffness is limited so that the heave natural period is sufficiently longer than the dominant wave energy periods. Lower tensioned stiffness, which is a key advantage of the present invention, is achieved by control of air volume, bottle size, and pressure in the riser tensioning system.

In an exemplary embodiment, a taut mooring system 315 may be used. Large excursions may lead to pull down risers 320 and reduce the available riser stroke compensation. Therefore, the mooring system is designed consistently with the riser system.

In an exemplary embodiment, risers 320 may be made of metallic material. Alternatively, composite material or a combination of metallic material and composite material may be used. The risers may be configured as, e.g., single or dual barrier risers. In some embodiments, buoyancy material may be added onto the risers, especially for the drilling riser.

In order to install the risers 320, there may be a need for access to a free opening diameter of, for example, three to five feet in all elevations from the rotary to the well head on the sea floor. Such access may be provided in the wellbay and through riser guiding devices. A top-tensioned riser 320 may be hung off in the tensioner "ring" that represents the interface between the tensioners and riser. The subsea well pattern may be spread out at a certain spacing to maintain sufficient clearance between risers.

In exemplary embodiments, the wellbay section 410 may be positioned in the center of the deck, close to the geometric center of the hull 310, in order to reduce the influence from roll, pitch, and yaw. Such positioning also enables a provision of proper clearance to the pontoon for the case without a riser guided frame 325. The wellbay structure 410 and well slot grid pattern 710 may have either a quadratic shape or a rectangular shape.

The wellbay structure 410 may be configured to carry a full operational drilling substructure 715 resting on top of the wellbay on a pair of skid beams integral with the wellbay structure. The wellbay structure 410 may utilize a truss design with fire proofing of its primary beam system. The wellbay area 410 may be naturally ventilated and designed to avoid large explosion pressures by means of minimum blockage effects through large openings in the neighboring bays of the deck box in at least two directions, including good ventilation upward as well as downward.

An open central compartment of the deck box may house the wellbay structure, which preferably features an open, naturally ventilated design with good explosion venting upwards, downwards, and sideways in, for example, two directions. The wellbay structures may span between the closed deck box plate bulkheads and receive rigidity from the deck box structure.

The large riser loads and drilling loads may be conveyed efficiently to the columns through the deck box central longitudinal and transverse full height bulkheads and multiple plated decks.

In the event of a fire in the wellbay, the use of a deck box design may enable better containment of the fire. Further, the use of a deck box design may provide improved performance with respect to global and local strength redundancy, as compared with an all-open truss deck construction. The deck box can be used to store riser accumulators, provide support for the riser tensioning system devices, and save the topside deck area. The interior of the deck box may be separated from the wellbay hazardous area and may have mechanically forced ventilation. The interior of the deck box may also allow for safe evacuation routes inside the deck box below the production deck.

Drilling may be performed with a surface BOP in a central well slot. Work-over may be performed on a particular well slot with a dedicated BOP. In a subsea well pattern, the platform may move around by means of its mooring system to reach a dedicated slot. Drilling can be performed based on predrilled wells (i.e., batch drilling of top holes) and tieback to platform with, for example, a high pressure riser system that may remain deployed in the sea at all times. Alternatively, a full drilling system may also be provided, thereby enabling drilling without the need for predrilled wells. A drilling module containing the mud treatment and pipe racks on top may be supported by the deck box.

In exemplary embodiments, the present invention provides several advantages. A first advantage is that the platform unit provides a cost-efficient and field-proven hull 310 and mooring system 315 for carrying a large topside 305. The platform unit described herein also offers a large deck area where one may obtain good segregation between hazardous areas and safe areas by utilizing safety-by-distance principles. The semi-submersible type of platform unit described herein has a proven record as operating platform for deep water production and drilling, and is applicable in all regions and water depths of the world.

Figure 7:
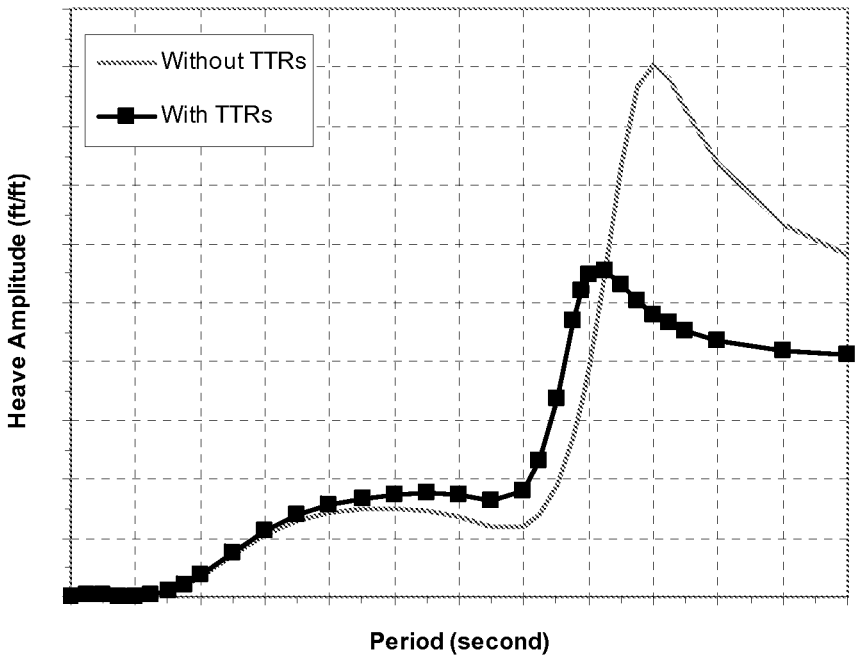
FIG. 7 illustrates a graph of an exemplary heave response-amplitude operator (RAO) for the platform unit of FIG. 2.
Figure 8:
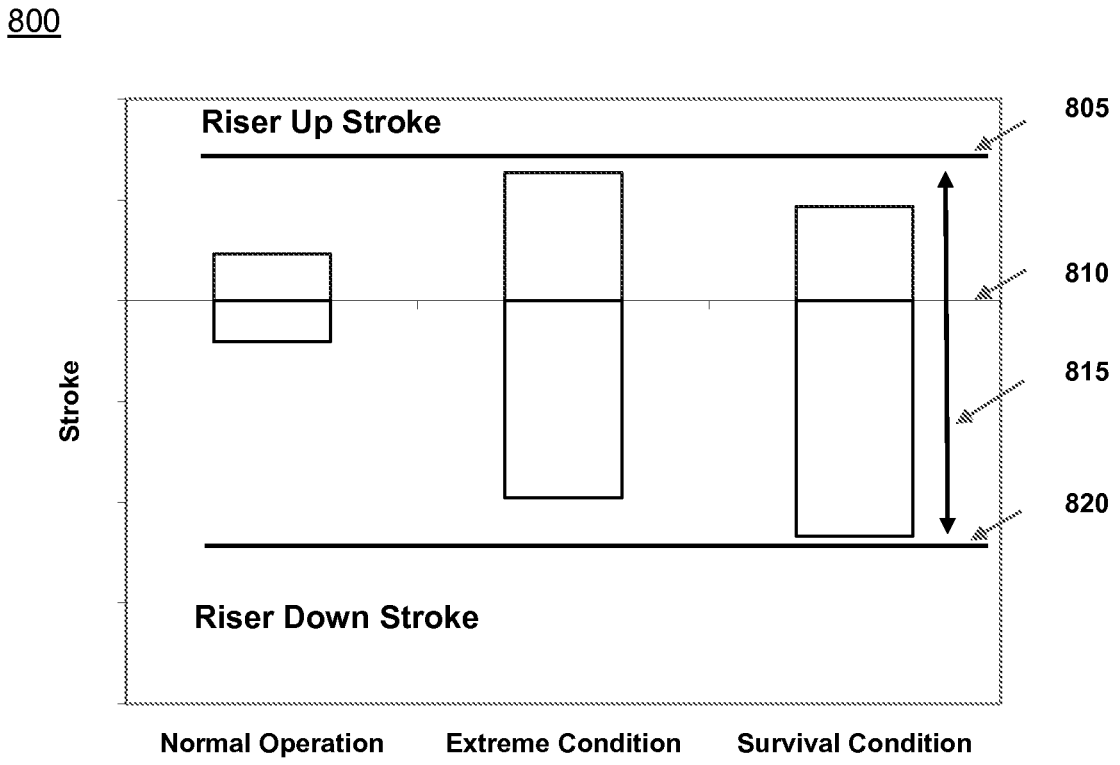
FIG. 8 illustrates a graph of an exemplary tensioner stroke range for the platform unit of FIG. 2.

Referring to FIG. 7, optimized motions suitable to risers may be achieved in a platform unit according to exemplary embodiments of the present invention. Graph 700 illustrates heave response amplitude operator versus period for an embodiment with top-tensioned risers compared with an embodiment without top-tensioned risers. Referring also to FIG. 8, a graph 800 illustrates a tensioner stroke range, including a maximum up stroke level 805, a nominal stroke position 810, and a maximum down stroke level 820. Thus, in the event that the tensioner bottoms out, the riser stress level remains within an allowable range. The platform unit may also implement a practical design of tensioner stroke range 815 which is well within the stroke capacity of existing industry-proven riser tensioners for compensation of platform motions.

Figure 9:
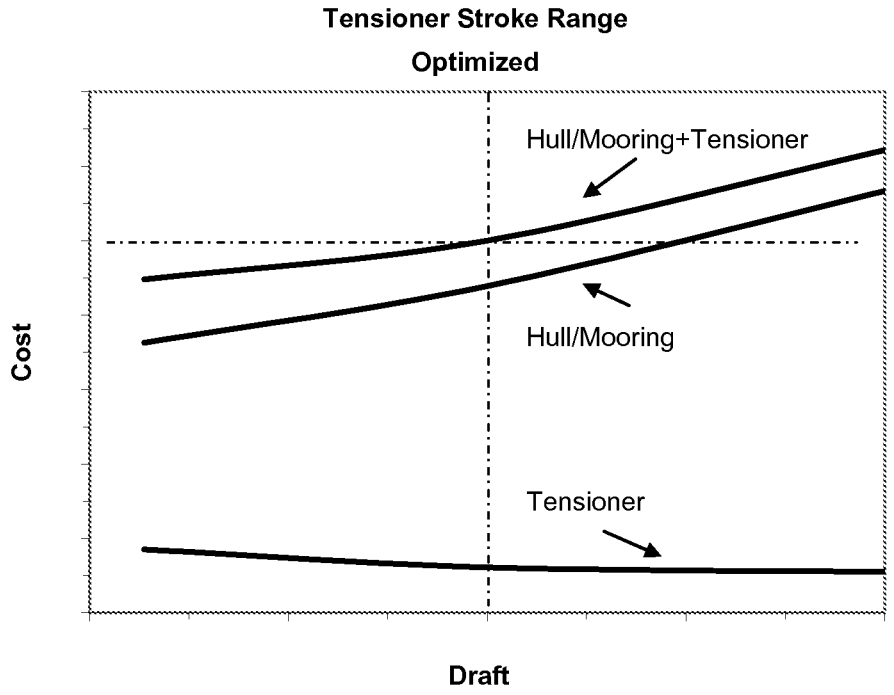
FIG. 9 illustrates a graph of an exemplary cost versus draft and tensioner stroke range for the platform unit of FIG. 2.

Referring to FIG. 9, a graph 900 illustrates a balancing of the costs of components, construction, and execution risk which may be achieved through integrated topside, hull, mooring, and riser systems. In addition, exemplary embodiments of the present invention may provide advantageous deep-water capability for large fields with large well counts. For example, the platform unit described herein can be used at any water depth, without limit, based on its operating principles, provided that the location is amenable to the use of an exploration rig. Further, the platform unit described herein is capable and flexible to support required payloads for field development with large well counts in deep or ultra-deep water, while maintaining simplicity and cost-effectiveness.

While various embodiments have been described above, it should be understood that they have been presented by way of example only, and not limitation. Thus, the breadth and scope of the present disclosure should not be limited by any of the above-described exemplary embodiments. Moreover, any combination of the above-described elements in all possible variations thereof is encompassed by the disclosure unless otherwise indicated herein or otherwise clearly contradicted by context.

What is claimed is:

1. A dry-tree semi-submersible production and drilling platform unit, comprising:

a semi-submersible hull portion, the hull portion including a ring pontoon and at least four columns connected to the ring pontoon;

a mooring portion anchored to a sea floor and mechanically coupled to each of the at least four columns;

a topside portion supported by the hull, the topside portion including a deck box with at least one of a plated bottom and a grated bottom;

a wellbay portion positioned in a central location of the deck box and configured to support a drilling substructure, a production substructure and a plurality of top-tensioned risers, the wellbay portion including a plurality of well slots arranged in a grid pattern, the drilling substructure configured to provide vertical access to each well slot in the grid pattern;

a top-tensioned riser portion including the plurality of top-tensioned risers and at least one of dry-trees and direct vertical access to each of the plurality of well slots;

a catenary riser portion including a plurality of steel catenary or flexible risers, each of the steel catenary or flexible risers being hung from the ring pontoon;

and a riser tensioning subsystem having a plurality of riser tensioners configured to provide vertical motion compensation for each of the plurality of top-tensioned risers, wherein the riser tensioning subsystem is characterized by a tension level parameter, a stroke length parameter, and a stiffness parameter, and wherein a set of values for the tension level parameter, the stroke length parameter, and the stiffness parameter is determined based on a field water depth, a number of wells in the wellbay portion, a predetermined top-tensioned riser configuration, and a predetermined topside capacity, wherein the tension level parameter, the stroke length parameter, the stiffness parameter, and a number of top-tensioned risers are determined such that an effective total stiffness of the riser tensioning subsystem is maintained within a range of between 10% and 30% of a platform water plane stiffness at in-place operating conditions.

2. The semi-submersible production and drilling platform unit of claim 1, further comprising a riser guide frame configured to constrain a rotation-induced moment on at least one of the plurality of riser tensioners.

3. The semi-submersible production and drilling platform unit of claim 1, wherein the hull portion has a draft configured between about 100 feet and 155 feet.

4. The semi-submersible production and drilling platform unit of claim 1, wherein the platform unit is configured such that a pontoon to platform displacement ratio is maintained in a range of between 0.3 and 0.5.

5. The semi-submersible production and drilling platform unit of claim 1, wherein the plurality of well slots is arranged in a grid pattern having a well spacing in a range of between 12 feet and 18 feet, wherein the grid pattern is one of a rectangular grid pattern and a square grid pattern.

6. The semi-submersible production and drilling platform unit of claim 1, wherein the drilling substructure uses an X-Y skidding system to provide the vertical access to each well slot in the grid pattern.

7. The semi-submersible production and drilling platform unit of claim 1, wherein the hull portion includes six columns and a truss deck, wherein the truss deck is integrated with the topside portion, and wherein the mooring portion is mechanically coupled to four of the six columns.

8. The semi-submersible production and drilling platform unit of claim 1, wherein the topside portion further includes an integrated truss deck.

9. A dry-tree semi-submersible production and drilling platform unit, comprising:

a semi-submersible hull portion, the hull portion including a ring pontoon and at least four columns connected to the ring pontoon;

a mooring portion anchored to a sea floor and mechanically coupled to each of the at least four columns;

a topside portion supported by the hull, the topside portion including a deck box with at least one of a plated bottom and a grated bottom;

a wellbay portion positioned in a central location of the deck box and configured to support a drilling substructure, a production substructure and a plurality of top-tensioned risers, the wellbay portion including a plurality of well slots arranged in a grid pattern, the drilling substructure configured to provide vertical access to each well slot in the grid pattern;

a top-tensioned riser portion including the plurality of top-tensioned risers and at least one of dry-trees and direct vertical access to each of the plurality of well slots;

a catenary riser portion including a plurality of steel catenary or flexible risers, each of the steel catenary or flexible risers being hung from the ring pontoon;

and a riser tensioning subsystem having a plurality of riser tensioners configured to provide vertical motion compensation for each of the plurality of top-tensioned risers, wherein the riser tensioning subsystem is characterized by a tension level parameter, a stroke length parameter, and a stiffness parameter, and wherein a set of values for the tension level parameter, the stroke length parameter, and the stiffness parameter is determined based on a field water depth, a number of wells in the wellbay portion, a predetermined top-tensioned riser configuration, and a predetermined topside capacity, wherein the hull portion is configured to suppress platform heave motions to enhance riser performance while maintaining a predetermined hull portion maximum height for quayside integration of the topside portion with the hull portion.

10. The semi-submersible production and drilling platform unit of claim 9, further comprising a riser guide frame configured to constrain a rotation-induced moment on at least one of the plurality of riser tensioners.

11. The semi-submersible production and drilling platform unit of claim 9, wherein the hull portion has a draft configured between about 100 feet and 155 feet.

12. The semi-submersible production and drilling platform unit of claim 9, wherein the platform unit is configured such that a pontoon to platform displacement ratio is maintained in a range of between 0.3 and 0.5.

13. The semi-submersible production and drilling platform unit of claim 9, wherein the platform unit is configured such that a heave natural period of the platform unit is maintained within a range of between 5 seconds and 8 seconds longer than a peak period of a predetermined governing design storm with all risers installed.

14. The semi-submersible production and drilling platform unit of claim 9, wherein the plurality of well slots is arranged in a grid pattern having a well spacing in a range of between 12 feet and 18 feet, wherein the grid pattern is one of a rectangular grid pattern and a square grid pattern.

15. The semi-submersible production and drilling platform unit of claim 9, wherein a configuration of the mooring portion is based on a nominal stroke position of each of the plurality of riser tensioners, the respective nominal stroke positions being determined in accordance with a predetermined maximum up stroke and a predetermined maximum down stroke relating to each of a normal operational mode, an extreme storm mode, and a survival mode.

16. The semi-submersible production and drilling platform unit of claim 9, wherein the drilling substructure uses an X-Y skidding system to provide the vertical access to each well slot in the grid pattern.

17. The semi-submersible production and drilling platform unit of claim 9, wherein the hull portion includes six columns and a truss deck, wherein the truss deck is integrated with the topside portion, and wherein the mooring portion is mechanically coupled to four of the six columns.

18. The semi-submersible production and drilling platform unit of claim 9, wherein the topside portion further includes an integrated truss deck.

19. A dry-tree semi-submersible production and drilling platform unit, comprising:

a semi-submersible hull portion, the hull portion including a ring pontoon and at least four columns connected to the ring pontoon;

a mooring portion anchored to a sea floor and mechanically coupled to each of the at least four columns;

a topside portion supported by the hull, the topside portion including a deck box with at least one of a plated bottom and a grated bottom;

a wellbay portion positioned in a central location of the deck box and configured to support a drilling substructure, a production substructure and a plurality of top-tensioned risers, the wellbay portion including a plurality of well slots arranged in a grid pattern, the drilling substructure configured to provide vertical access to each well slot in the grid pattern;

a top-tensioned riser portion including the plurality of top-tensioned risers and at least one of dry-trees and direct vertical access to each of the plurality of well slots;

a catenary riser portion including a plurality of steel catenary or flexible risers, each of the steel catenary or flexible risers being hung from the ring pontoon;

and a riser tensioning subsystem having a plurality of riser tensioners configured to provide vertical motion compensation for each of the plurality of top-tensioned risers, wherein the riser tensioning subsystem is characterized by a tension level parameter, a stroke length parameter, and a stiffness parameter, and wherein a set of values for the tension level parameter, the stroke length parameter, and the stiffness parameter is determined based on a field water depth, a number of wells in the wellbay portion, a predetermined top-tensioned riser configuration, and a predetermined topside capacity, wherein the platform unit is configured such that a heave natural period of the platform unit is maintained within a range of between 5 seconds and 8 seconds longer than a peak period of a predetermined governing design storm with all risers installed.

20. A dry-tree semi-submersible production and drilling platform unit, comprising:

a semi-submersible hull portion, the hull portion including a ring pontoon and at least four columns connected to the ring pontoon;

a mooring portion anchored to a sea floor and mechanically coupled to each of the at least four columns;

a topside portion supported by the hull, the topside portion including a deck box with at least one of a plated bottom and a grated bottom;

a wellbay portion positioned in a central location of the deck box and configured to support a drilling substructure, a production substructure and a plurality of top-tensioned risers, the wellbay portion including a plurality of well slots arranged in a grid pattern, the drilling substructure configured to provide vertical access to each well slot in the grid pattern;

a top-tensioned riser portion including the plurality of top-tensioned risers and at least one of dry-trees and direct vertical access to each of the plurality of well slots;

a catenary riser portion including a plurality of steel catenary or flexible risers, each of the steel catenary or flexible risers being hung from the ring pontoon;

and a riser tensioning subsystem having a plurality of riser tensioners configured to provide vertical motion compensation for each of the plurality of top-tensioned risers, wherein the riser tensioning subsystem is characterized by a tension level parameter, a stroke length parameter, and a stiffness parameter, and wherein a set of values for the tension level parameter, the stroke length parameter, and the stiffness parameter is determined based on a field water depth, a number of wells in the wellbay portion, a predetermined top-tensioned riser configuration, and a predetermined topside capacity, wherein a configuration of the mooring portion is based on a nominal stroke position of each of the plurality of riser tensioners, the respective nominal stroke positions being determined in accordance with a predetermined maximum up stroke and a predetermined maximum down stroke relating to each of a normal operational mode, an extreme storm mode, and a survival mode.

* * * * *